US005639104A

United States Patent [19]

Haldemann

[11] Patent Number: 5,639,104

[45] Date of Patent: Jun. 17, 1997

[54] IN-LINE ROLLER SKATE

[75] Inventor: Gaston Haldemann, Burgenstock, Switzerland

[73] Assignee: Skis Rossignol S.A., Voiron, France

[21] Appl. No.: 704,114

[22] Filed: Aug. 28, 1996

[30] Foreign Application Priority Data

Sep. 5, 1995 [CH] Switzerland ..... 2-529/95

[51] Int. Cl.[6] ..... A63C 17/14

[52] U.S. Cl. ..... 280/112; 280/11.22

[58] Field of Search ..... 280/11.19, 11.2, 280/11.22, 11.23, 11.28, 87.041, 87.042

[56] References Cited

U.S. PATENT DOCUMENTS 5,088,748 2/1992 Koselka et al. ..... 280/11.2
5,135,244 8/1992 Allison ..... 280/11.2
5,192,099 3/1993 Riutta .
5,478,094 12/1995 Pennestri ..... 280/11.2

FOREIGN PATENT DOCUMENTS

WO93/16773 9/1993 WIPO .
WO94/22542 10/1994 WIPO .

*Primary Examiner*—Richard M. Camby
*Attorney, Agent, or Firm*—Kane, Dalsimer, Sullivan Kurucz, Levy, Eisele and Richard, LLP

[57] ABSTRACT

The roller skate is fitted with a brake comprising at least one pair of disks (16, 17) supporting, through their tapered side, the two sides of at least the rear wheel (6) when the skater displaces his or her weight backwards. Braking is effected through the friction of the disks on the wheel, i.e. through the friction of the flat side of the disks on a brake lining. In one system of operation, the disks are fitted on a support fixed to the boot and joined to a frame bearing the wheels. In another system of operation, the disks are fitted on a main frame bearing the boot and the front wheels, the two rear wheels being fitted on an auxiliary frame joined to the main frame.

14 Claims, 5 Drawing Sheets

FIG. 2
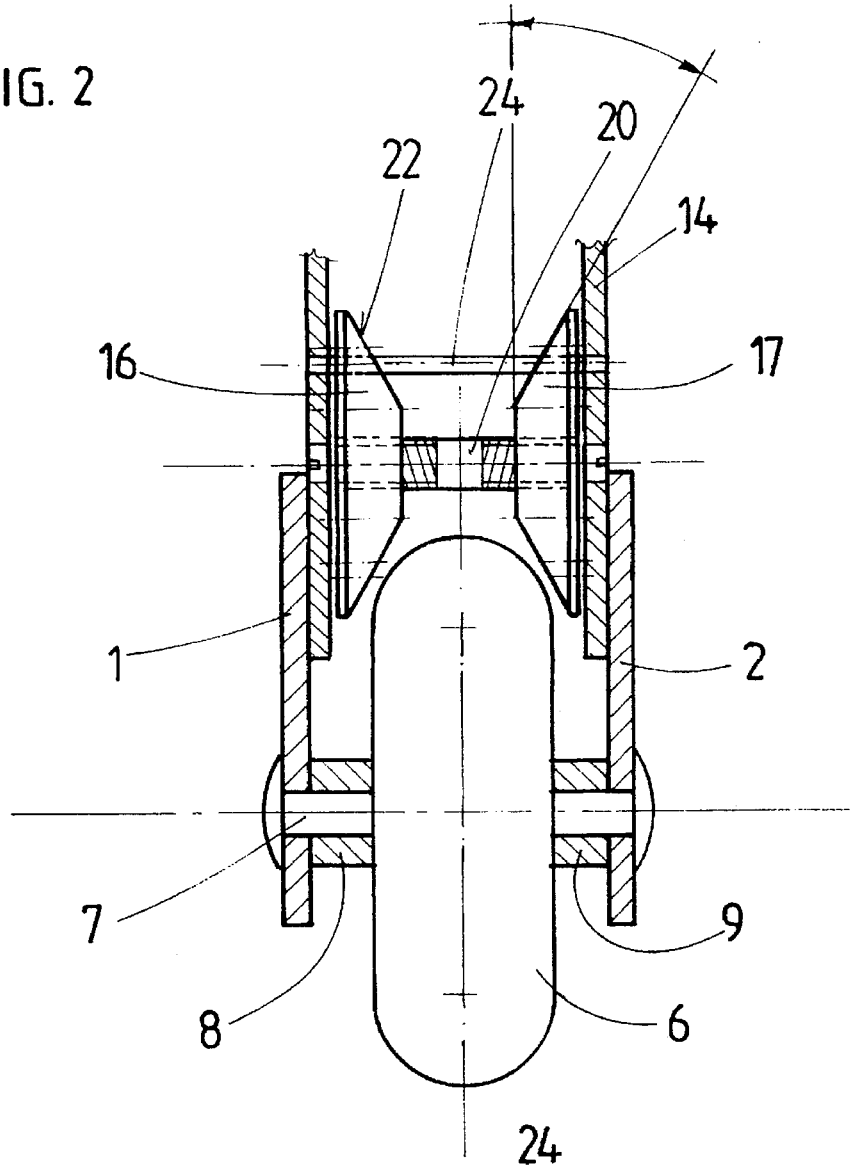
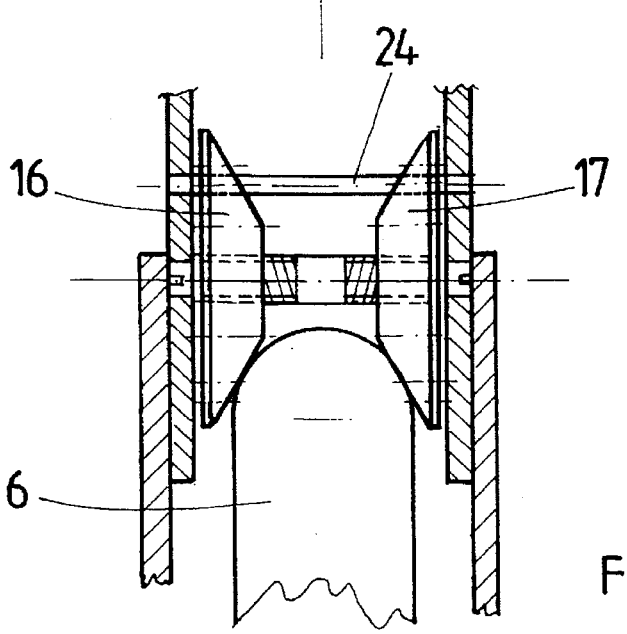
FIG. 3

FIG.6
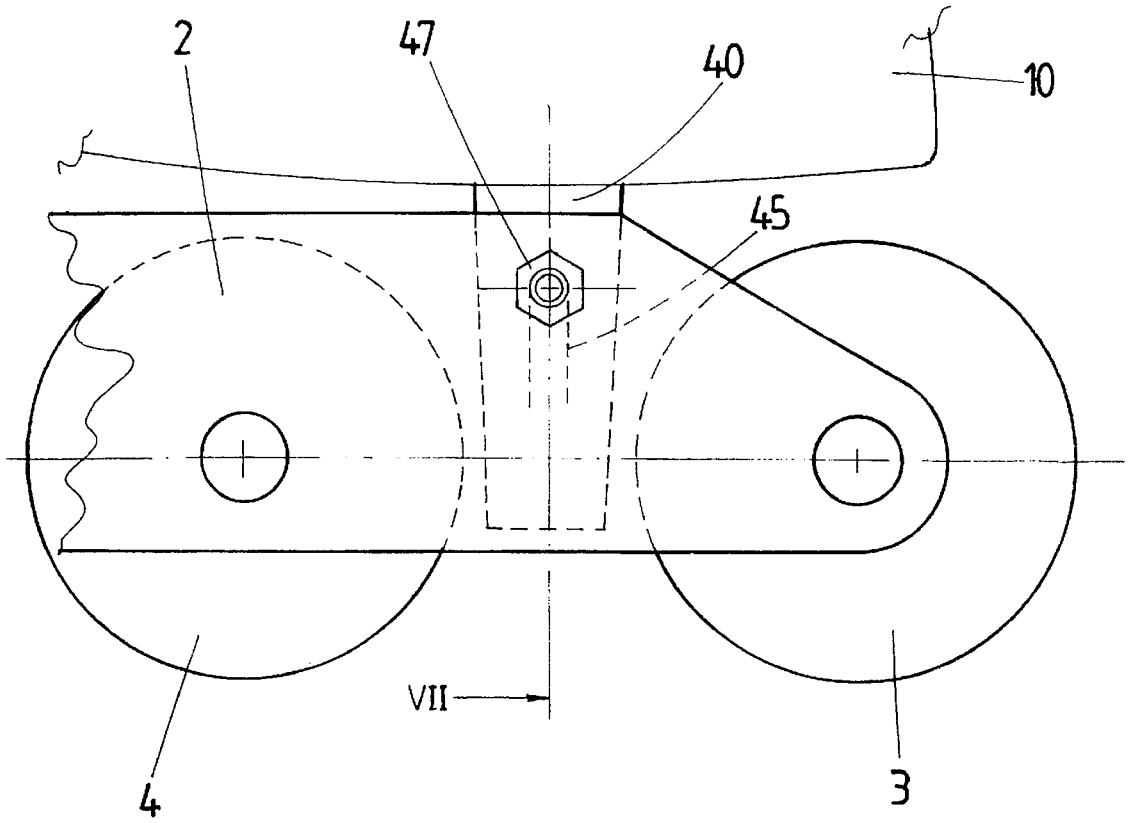
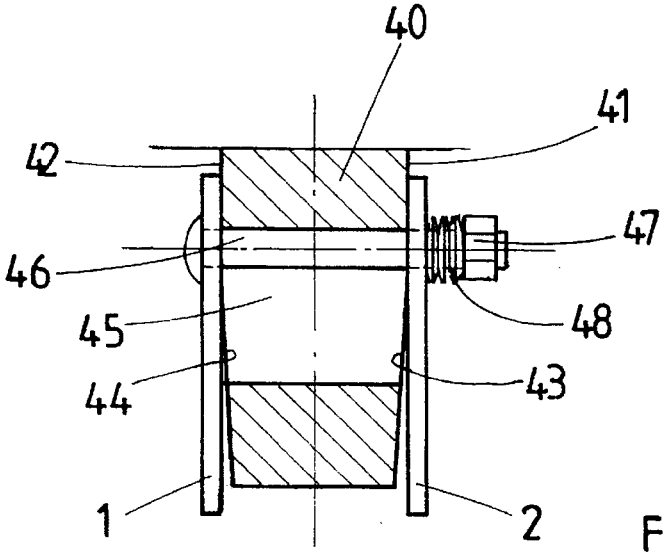
FIG.7

IN-LINE ROLLER SKATE

FIELD OF THE INVENTION

The object of this invention is a in-line roller skate comprising a minimum of three wheels where the rear wheel and at least one other wheel are fitted on a frame pivoting on a boot support around an axle which runs parallel to the wheel axles, a fixed brake on the said support acting, at the very minimum, on the rear wheel through the reverse tilting of the boot support and a limited resistance lock retention system for countering the reverse tilting of the boot support.

In-line roller skates are generally fitted at the back with a brake block which effects braking through friction against the ground when the skater tilts the rear wheel backwards. The quality of braking obtained depends upon the nature of the ground. It is irregular and entails unpleasant vibrations. In addition, the block protrudes, at the rear of the skate, which may cause problems on certain uneven ground, in particular when descending a step or pavement.

PRIOR ART

In document EP-A-0 607 817, a proposal was made to improve this braking system by replacing the block with a fixed roller at the end of one arm of a platform balance the other arm of which is fitted with a brake block acting on the wheel. This brake still depends upon the nature of the ground and the braking irregularities and vibrations are not eliminated, whilst the block still protrudes problematically at the rear.

In document DE-A-26 45 192, a proposal was made to construct a downhill roller skate, single-line or otherwise, where braking is ensured through the reverse tilting of the boot support on the wheel frame around an axle situated slightly in front of the rear wheel, the effect of this tilting system being to apply a brake lining to a fixed wheel from the rear wheels or on the rear wheel itself. In the front, a pull-back spring tends to return the support to its normal non-brake mode position.

A similar style braking system is described in document NL-A-92 01 946. This skate comprises a platform mounted flexibly on four wheels fitted in pairs on independent oscillating supports. The platform is fitted at the rear with a brake block which directly acts on the rear wheel. The tilting axle on the platform is combined with the rear oscillating support axle. A similar skate is described in patent U.S. Pat. No. 1,342,071.

In all these skates, it is always the same narrow area of the brake block which is in contact with the wheel. This friction zone is thus used far more quickly than the rest of the block and this becomes smoother and shinier sooner, reducing the effect of braking. A relatively frequent replacement of the brake block is thus required.

SUMMARY OF THE INVENTION

The aim of the invention is to avoid having to replace the brake blocks and increase the effectiveness of braking.

The roller skate in accordance with the invention is characterised by the fact that the brake is comprised of at least one pair of opposing coaxial disks each with a roughly tapered side intended to come into contact with one side of the wheel.

The disks may be totally immobilised and act on the wheel through friction against the wheel itself or they may be driven by the wheel and brake through friction on a brake lining. In the first case, the disks may be beneficially immobilised in different angular positions, so that the part of the disks in contact with the wheel may be modified. In the second case, the area of the disks in contact with the wheel changes constantly.

According to the preferred system of operation for the invention, the disks are driven by the wheel and the sides of them which run opposite to the tapered sides are in contact with a brake lining fixed to the frame or to an auxiliary support bearing the two rear wheels or they are fitted with a brake lining which acts on the frame or the auxiliary support bearing the rear wheels. In this case, braking occurs partly as a result of the friction on the brake lining in such a way that the wheel heats up to a lesser extent and the dissipation of heat in terms of the linings is ensured by the frame and rear-wheel support respectively.

The sliding of the disks on the wheel can, moreover, be further reduced by forming, on the tapered sides of the disks, a sort of honeycomb-shaped cog matching the shape of the wheel so that the disks are more easily driven by the wheel.

BRIEF DESCRIPTION OF THE DRAWINGS

The appended drawing represents several embodiments of the invention.

FIG. 2 is a partial cutoff view according to II—II of FIG. 1, in the moving position.

FIG. 3 is a view similar to FIG. 2 in the braking position.

FIG. 6 represents a variant on the boot support lock retention system on the frame.

FIG. 7 is a cutoff view according to VII—VII of FIG. 6.

DESCRIPTION OF THE PREFERRED EMBODIMENT(S)

Figure 1:
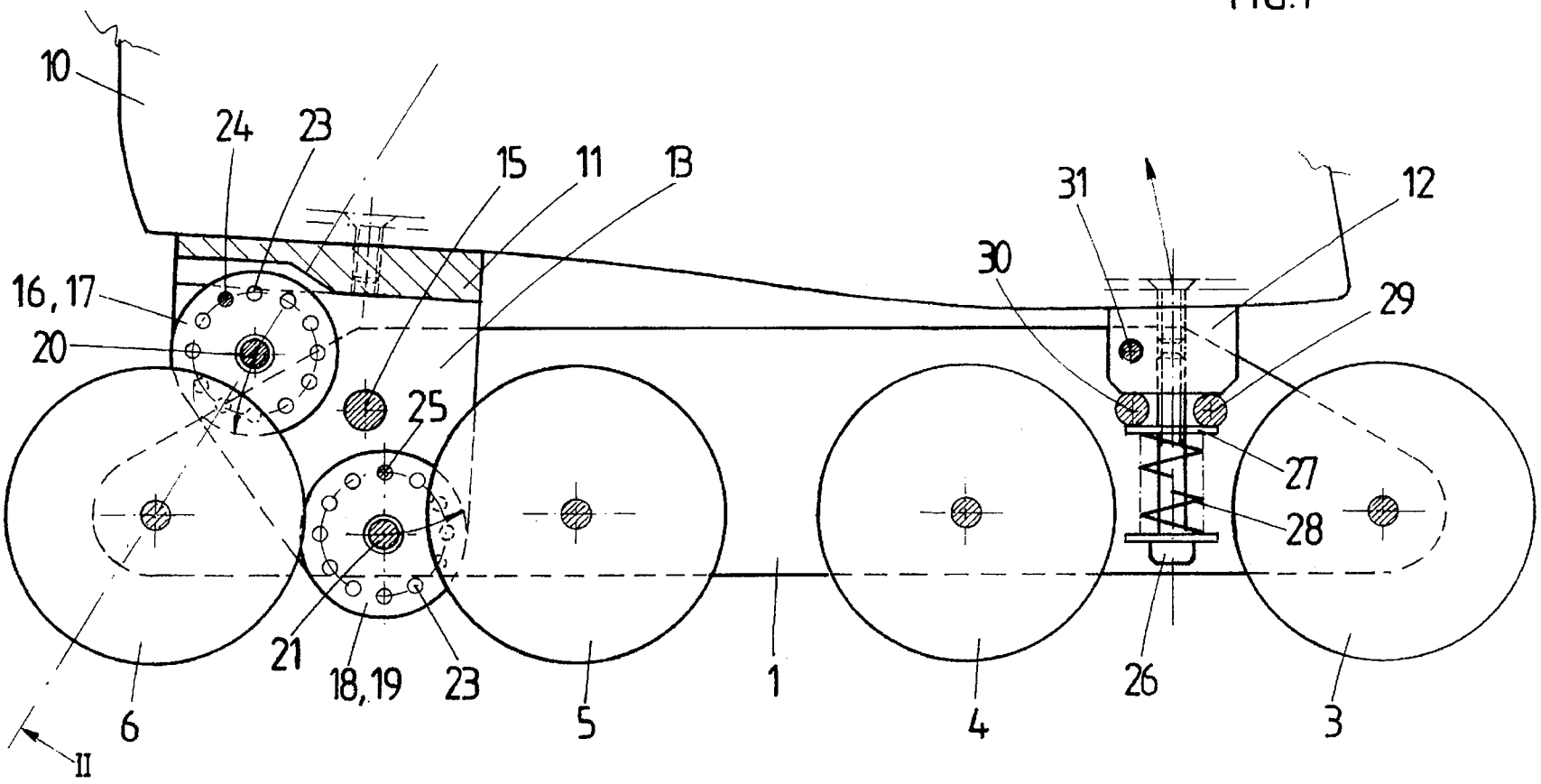
FIG. 1 is a side-view, with partial axial cutoff, of the first method of operation.

The in-line roller skate represented in FIGS. 1 and 2 comprises a frame made up of two parallel plates 1 and 2 between which are fitted four wheels in a single line 3, 4, 5, 6 fitted on ball bearings on two axles as per axle 7. Plates 1 and 2 are separated from the wheels using cross-struts 8 and 9 supported on the internal raceways of the ball bearings.

The skate comprises a fixed boot 10 on a platform to which are fitted, at the rear, a support 11 and, at the front, a block 12. The support 11, has two vertical guards 13 and 14 located between plates 1 and 2 of the frame. Support 11 is joined to the frame 1 by an axle 15 situated between the two rear wheels 5 and 6 and the axles of these wheels and the boot 10. Moreover, between guards 13 and 14 of the support 11 are fitted two identical pairs of disks 16, 17 and 18, 19. The pair of disks 16, 17 are fitted on an axle 20 comprising a double-thread screw screwing in opposite directions respectively in each of disks 16 and 17. In the same way, the pair of disks 18, 19 are fitted on an identical screw 21. Screws 20 and 21 mm freely in support 11. The shafts of screws 20 and 21 are at the same distance from axle 15 and the distance between the shaft of screw 20 and wheel 6 is the same as the distance between the shaft of screw 21 and wheel 5. The disks have a tapered side 22 facing the wheels and are, moreover, fitted with holes 23 distributed regularly and circularly over the disk. These holes enable the rotating disks to be immobilised through the use of a small bar 24, and respectively 25, crossing the pair of disks and guards 13 and 14 on the support.

At the front, in the block 12, there is a screw 26 between the head of which and a washer 27 is fitted a pre-compressed spring 28. Between the washer 27 and the block 12 are cramped two pins 29 and 30 linking plates 1 and 2 of the frame. The front of the boot is thus held flexibly in the flame, the resistance to tilting around axle 15 being governed by modifying the precompression of spring 28 using screw 26. A moveable pin 31 enables the possibility of locking the block 12 on to the frame 1, 2 if so required.

Braking is effected through the reverse tilting of the boot 10 around the axle 15. As it is tilted, the disks 16 and 17 come into contact, on their tapered side, with either side of wheel 6. Likewise, disks 18 and 19 of the second pair of disks come into contact with wheel 5. The rotating disks being immobilised, the wheels are stopped by means of friction.

The clamping of the disks may be governed by screws 20 and 21. Where these disks become worn, it is possible to ensure that another area of the disks comes into contact with the wheels immobilising the disks in another angular position.

The wheels are, for example, in polyurethane and the disks in stainless steel or bronze.

Figure 4:
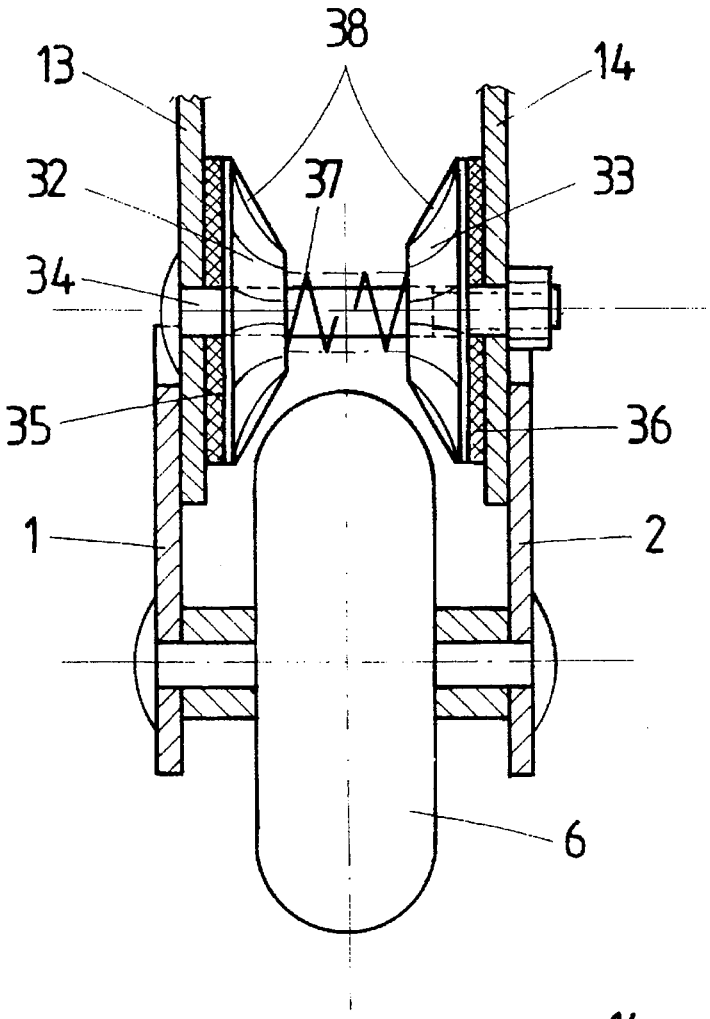
FIG. 4 is a view similar to FIG. 2 which illustrates the two methods of realisation.
Figure 5:
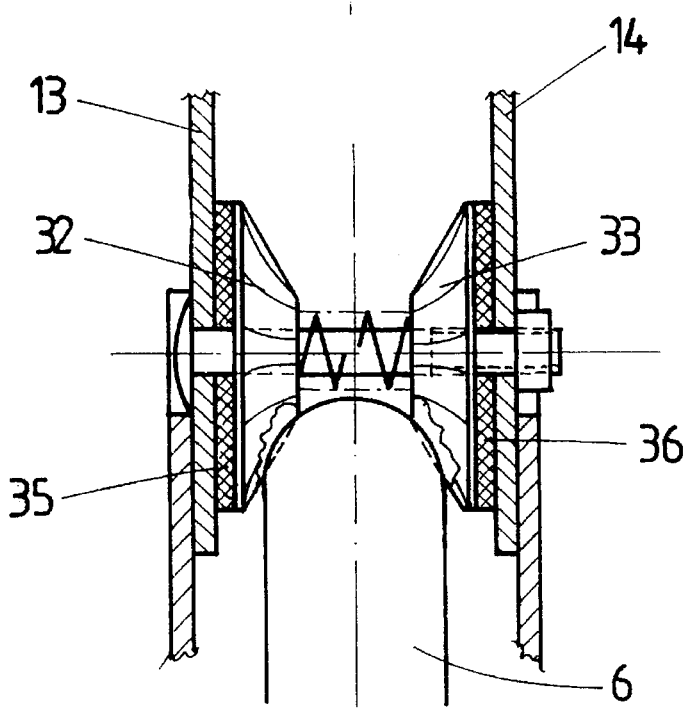
FIG. 5 represents this second option in the braking position.

In the second system of operation represented in FIGS. 4 and 5, disks 16 and 17 are replaced by disks 32 and 33 fitted freely on an axle 34. These disks have an external flat side in contact with the brake linings 35 and 36 fixed to guards 13 and 14 respectively. Disks 32 and 33 are held against the brake linings by a spring 37 operating subject to light compression between the two disks. Disks 32 and 33 also have tapered sides in which hollows 38 are created forming a sort of conical cog, this cog 38 being in the best adaptable shape to that of wheel 6.

When the boot is tilted backwards, wheel 6 engages the disks in two grooves 38 so as to drive these disks around and, simultaneously, separate these disks from each other by pressing them against the brake linings 35 and 36. Braking is thus not only effected through friction between wheel 6 and the disks but essentially through friction between the disks and the brake linings. The wear and tear of the wheel through braking is thus vastly reduced and the choice of appropriate materials for the disks and brake linings enables the brake to have an extremely extensive service life.

The brake linings may be fixed to the disks.

In accordance with an operational variant not represented, the wheel 6 is fitted with two conical cog cheeks, in metal or plastic, intended to create gearing contact with a conical cog shaped on the brake disks. It would thus be possible to increase braking efficiency slightly.

In conjunction with spring 28 or instead of this spring, it is possible to provide for a flexible locking device on the front support 12 of the frame. This locking device can be constructed from two balls fitted in support 12 and each can be engaged in a hole with a smaller diameter than that of the balls provided for in each of plates 1 and 2 of the frame and pressured by a spring operating subject to compression between the balls. It is thus possible to avoid an untimely tilting of the boot. This snap-in locking system may be ensured by a single ball.

FIGS. 6 and 7 represent a simplified system of operation for the devices countering, at the front, the tilting of the boot. The front of the boot 10 is fitted with a block 40 in synthetic material and restricted laterally, in its upper section mad a little under the halfway point of its height, by two lateral walls 43 and 44 which are slightly convergent. This block 40 is engaged between the parallel plates 1 and 2 of the frame and presents a vertically oblong elongated hole 45. The block 40 is cramped between plates 1 and 2 of the frame by a bolt 46 crossing the oblong elongated hole 45 and fitted with a nut 47 and a set of washer-springs compressed between the nut 47 and the plate 1. In the normal skating position, the bolt 46 is abutted against the upper end of the oblong elongated hole 45. The nut 47 is tightened in such a way that the skater can overcome the friction of plates 1 and 2 against the block 40 by tilting backwards. The friction is reduced when the bolt 46 enters the area of the convergent walls 43 and 44, i.e. around the middle of the oblong elongated hole 45. The nut 47 enables the possibility of adjusting the resistance of the lock retention in relation to the weight of the skater.

Braking can also be provided for solely on the rear wheel 6.

Braking on the two rear wheels offers real interest in cases where the four wheels are assembled in pairs on supports oscillating around a central axle. In this case, the adherence of the two front wheels may disappear whilst the adherence of the penultimate rear wheel, i.e. wheel 5, is retained.

Figure 8:
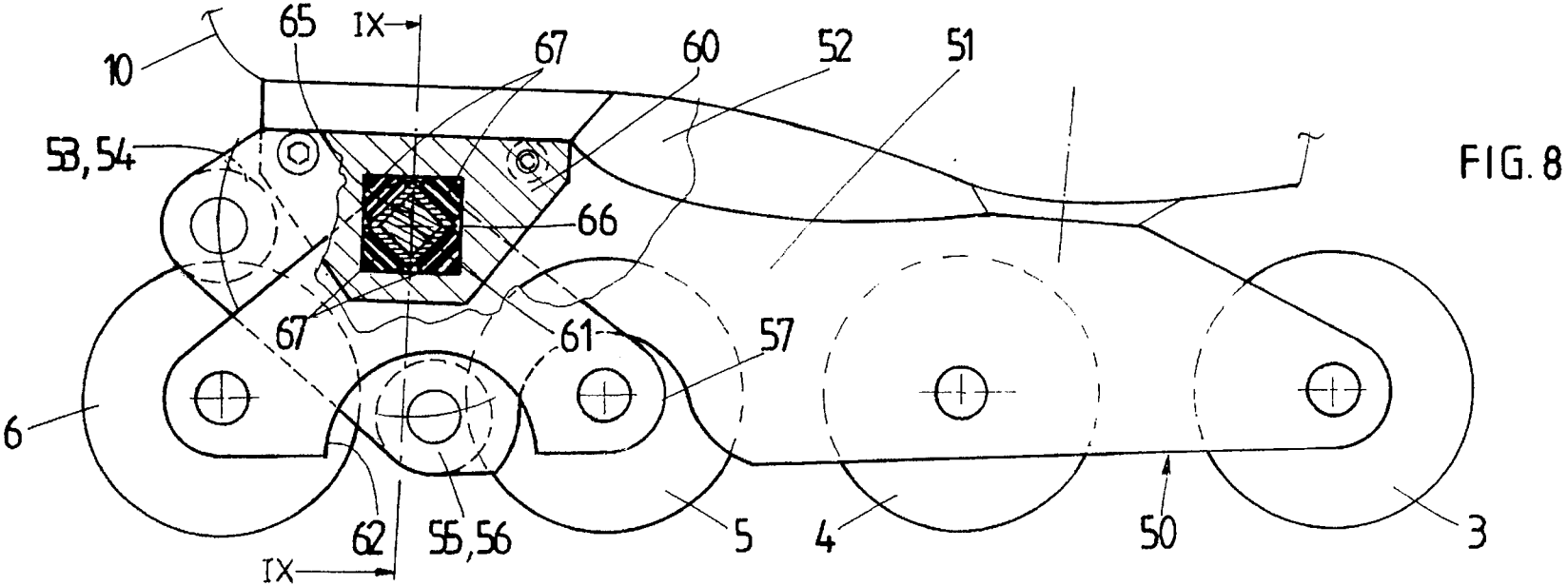
FIG. 8 represents a third system of operation.
Figure 9:
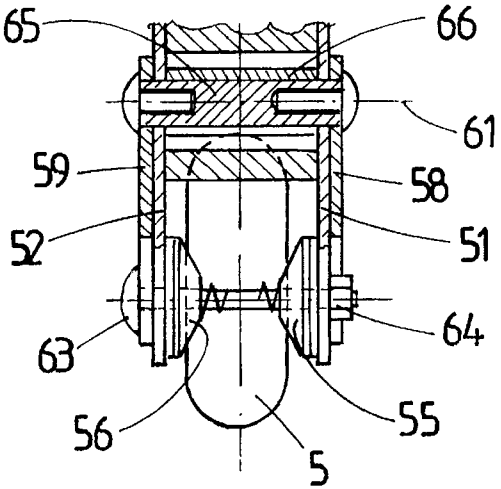
FIG. 9 is a partial cutoff view according to IX—IX of FIG. 8.

FIGS. 8 and 9 represent a third system of operation characterised by the fact that the brake disks are fitted on the frame.

Under this system of operation, the boot 10 is fitted absolutely rigidly and fixed to a frame 50 comprising two parallel plates 51 and 52 fixed on a heel base 60 and bearing the two front wheels 3 and 4 and two pairs of brake disks 53, 54 and 55, 56 intended to act on the last wheel 6 and the penultimate wheel 5, respectively. These disks are similar to disks 32 and 33 of the second system of operation, smooth or indexed. The rear wheels 5 and 6 are fired on an auxiliary frame 57 fitted and pivoting on the main frame 50 around an axle 61 situated at the same distance from the axles of wheels 5 and 6, under the heel of the boot. The auxiliary frame 57 comprises two parallel plates 58 and 59 with a cutting 62 leaving room for the bolt 63 and nut 64 from the pair of disks 55, 56.

The joint 61 is a flexible joint which twists, in the case in point, a ROSTA (registered trademark) device tending to hold the auxiliary frame 57 in the position represented in FIG. 8, i.e. in a position whereby the four wheels are resting on a horizontal ground surface.

By way of information, the ROSTA device comprises a shaft with a square cross-section housed in a fixed tube 66 also with a square cross-section, in which the shaft 65 is maintained angularly by four elastomer bars 67. This type of twisting system may also be used in the preceding systems of operation instead of the pull-back and front locking systems.

As in the preceding case, braking is effected by displacing the weight of the body backwards, the effect of which is to tilt the boot, with the frame 50, around the axle 58. In this case, the weight of the skater also remains distributed over wheels 5 and 6 and braking is effected in the same way on these two wheels.

The incline of the tapered sides of the disks is chosen so as to avoid a jamming of the disks between the wheels and the frame as a result of a comer whilst avoiding friction on the running tread of the wheels and retaining an important component in the application of the disks against the brake linings in the case of disks driven in rotation. This incline is between 35° and 55°, preferably 45°.

With regard to the construction of frames and distribution of wheels on the frames, the invention is clearly not limited to the systems of operation represented in FIGS. 1 and 8. For example, the boot could be fixed on a frame fitted with a single front wheel and joined to a frame fitted with three wheels. Braking could be effected using these three wheels. The frame fixed to the boot could be fitted with two wheels and joined to an auxiliary frame around the axle of the rear wheel of the main frame, the wheels of the auxiliary frame being arranged in front of and behind the rear wheel of the main frame. In this case, braking could be effected using a pair of disks acting simultaneously on the two rear wheels of the skate.

I claim:

1. In-line roller skate comprising a minimum of three wheels (3, 4, 5, 6) where the rear wheel (6) and at least one other wheel (5) are fitted on a frame (1, 2; 57) pivoting on a boot support (11, 12; 50) around an axle (15) which rims parallel to the wheel axles, a fixed brake on the said support acting, at the very minimum, on the rear wheel (6) through the reverse tilting of the boot support and a limited resistance lock retention system (26, 28; 40, 46) for countering the reverse tilting of the boot support, wherein the brake is comprised essentially of at least one pair of counter coaxial disks (16, 17; 32, 33; 53, 54) each with a roughly tapered side intended to come into contact with one side of the wheel (6).

2. Skate according to claim 1, wherein the disks (16, 17) are immobilised in rotation by a locking system (24) so that braking is effected through the friction of the disks on the wheel.

3. Skate according to claim 2, wherein the locking system is a small bar (24) crossing the disks and the boot support.

4. Skate according to claim 3, wherein the disks (16, 17) have several holes (23) through which the small bar can pass in order to be able to modify the area of contact between the disks and the wheel.

5. Skate according to claim 2 wherein the disks (16, 17) are fitted on to a two-stage screw screwing in opposite directions (20) enabling the possibility of modifying the separation distance of the disks.

6. Skate according to claim 1 wherein the disks (32, 33; 53, 54) are driven by the wheel (6) and that their sides opposite to their tapered sides are respectively in contact with a fixed brake lining (35, 36) or are fitted with a brake lining in contact with the frame or a wheel support attached to the frame.

7. Skate according to claim 6 wherein the tapered sides of the disks are toothed and that the wheel is fitted with conical toothed shields or cheeks gearing the disks during braking.

8. Skate according to claim 1 wherein the lock retention system on the boot support comprises at least a spring (28) operating subject to compression and a control system (26) for the pre-compression of this spring.

9. Skate according to claim 1 wherein the lock retention system comprises at least one ball pressured by a spring into a hole with a diameter which is smaller than the diameter of the ball, a system being provided for to adjust the pre-compression of spring, the ball being fixed to the boot support and the hole being provided for in the frame or vice-versa.

10. Skate according to claim 1 where the boot support has, at the front, a block made from synthetic material (40) on the frame, characterised by the fact that the lock retention system on the boot support constitutes a flexible securing system (46, 47, 48) securing the said block (40) between the two parallel plates (1, 2), the sides (43, 44) of the block being slightly convergent below the securing system so as to reduce tightening when said flexible securing system wedges the block in the convergent part.

11. Skate according to claim 10, wherein the flexible securing system comprises a bolt (46), a nut (47) and a spring (48) between the nut and one of the plates of the frame.

12. Skate according to claim 1, wherein the lock retention system on the boot support comprises a flexible pull-back device turning the axle (15; 61) joining the frame to the boot support.

13. Skate according to claim 1, wherein it comprises a second pair of disks (18, 19; 55, 56) identical to the first and working with the penultimate wheel (5).

14. Skate according to claim 1, wherein the incline of the tapered sides on the coaxial disks is between 35° and 55°, preferably 45°.

* * * * *